US007954278B2

(12) United States Patent
Schaaf et al.

(10) Patent No.: US 7,954,278 B2
(45) Date of Patent: Jun. 7, 2011

(54) DEVICE FOR TAKING THE WEIGHT OF A ONE-LEAF OR TWO-LEAF DOOR FOR A SWITCHGEAR CABINET

(75) Inventors: Harry Schaaf, Rheinmünster (DE); Mustafa Atmaca, Lichtenau (DE)

(73) Assignee: ABB Patent GmbH, Ladenburg (DE)

( * ) Notice: Subject to any disclaimer, the term of this patent is extended or adjusted under 35 U.S.C. 154(b) by 826 days.

(21) Appl. No.: 10/577,155

(22) PCT Filed: Oct. 25, 2004

(86) PCT No.: PCT/EP2004/011027

§ 371 (c)(1),
(2), (4) Date: Mar. 26, 2007

(87) PCT Pub. No.: WO2005/052296

PCT Pub. Date: Jun. 9, 2005

(65) Prior Publication Data

US 2008/0034665 A1 Feb. 14, 2008

(30) Foreign Application Priority Data

Oct. 29, 2003 (DE) ..... 103 50 443

(51) Int. Cl.
*E05F 7/06* (2006.01)

(52) U.S. Cl. ..... 49/396

(58) Field of Classification Search ..... 49/234, 49/236, 394, 395, 396; 292/DIG. 21, DIG. 55, 292/DIG. 46
See application file for complete search history.

(56) References Cited

U.S. PATENT DOCUMENTS 489,220 A * 1/1893 Currier ..... 292/1
1,579,619 A * 4/1926 Kerby ..... 292/19
1,654,163 A * 12/1927 Evans ..... 292/300
1,766,183 A * 6/1930 Mealia ..... 16/82
(Continued)

FOREIGN PATENT DOCUMENTS

DE 12 06 739 B 12/1965
(Continued)

*Primary Examiner* — Jerry Redman
(74) *Attorney, Agent, or Firm* — Buchanan Ingersoll & Rooney PC

(57) ABSTRACT

A device for taking the weight of a one-leaf or two-leaf door for a switchgear cabinet, a frame of which is made up of profiled bars, in the case of a one-leaf door a free vertical side edge of the door striking against a vertically running profiled bar and in the case of a two-leaf door the vertical free side edges touching or ending at a small distance from one another when the two-leaf door is closed. The device includes at least one guiding element with at least two respective run-up slopes, which in the case of a one-leaf door is arranged in the region on the free side edge and interacts with a run-up edge on the profiled bar against which the door strikes in such a way that, during closing, the guiding element slides with its run-up slope onto the run-up edge and thereby takes part of the weight of the door, and which in the case of a two-leaf door, is arranged in the region of the upper side edge and in the vicinity of the free side edges of each door leaf and, during closing, runs with its run-up slope onto a respective run-up edge at least on the upper horizontally running profiled bar, and consequently takes part of the weight of the door leaves.

6 Claims, 3 Drawing Sheets

U.S. PATENT DOCUMENTS

| | | | | |
|---|---|---|---|---|
| 2,010,468 | A * | 8/1935 | Spencer | 49/236 |
| 2,860,903 | A * | 11/1958 | Narancich et al. | 292/48 |
| 3,579,934 | A * | 5/1971 | Pietsch | 49/394 |
| 4,861,099 | A * | 8/1989 | Sasamura et al. | 296/202 |
| 5,628,148 | A * | 5/1997 | Beutler | 49/394 |
| 5,937,585 | A * | 8/1999 | Tidbury et al. | 49/504 |
| 6,039,364 | A * | 3/2000 | Rieger et al. | 292/300 |
| 6,971,686 | B2 * | 12/2005 | Becken | 292/39 |
| 7,168,745 | B2 * | 1/2007 | Jamnia et al. | 292/302 |
| 7,228,595 | B2 * | 6/2007 | Tudora et al. | 16/86 B |
| 7,275,770 | B2 * | 10/2007 | Guebre-Tsadik et al. | 292/145 |
| 7,370,890 | B2 * | 5/2008 | Samsel | 292/42 |
| 7,524,002 | B2 * | 4/2009 | Punzel et al. | 312/217 |

FOREIGN PATENT DOCUMENTS

| | | |
|---|---|---|
| DE | 297 12 027 U | 9/1997 |

* cited by examiner

DEVICE FOR TAKING THE WEIGHT OF A ONE-LEAF OR TWO-LEAF DOOR FOR A SWITCHGEAR CABINET

BACKGROUND

1) Field of Invention

The disclosure relates to a device for taking the weight of a one leaf or two leaf door for a switchgear cabinet.

2) Description of Related Art

An electronic switchgear cabinet in which components, in particular for a low voltage, are installed, has an electrical frame, which is made up of profiled bars which are mechanically connected to one another at their corners by means of a corner connector. In addition, a switchgear cabinet of this type has a door, which may be formed as a one-leaf door or two-leaf door. The one-leaf door is hinged with a vertical side edge on a vertical profiled bar at the front; with the other side edge, the door strikes against the other vertical profiled bar and can be locked there by means of a closure. In the case of some switchgear cabinets, such a closure is formed by two vertically running rods, which are moved upward and downward by means of a manually operable rotary handle; the upper closure rod moves upward and the lower one moves downward to achieve closure of the door. There is also the possibility of using the rotary handle to operate a pivoting blade which can engage behind a stop on the vertical profiled bar.

In the case of a two-leaf door, both leaves are suspended in a hinged manner on a respective profiled bar with their one, respectively opposite, vertically running side edges; in the closed state, the door leaves overlap and the closure takes place, as in the case of a one-leaf door, by manually driven closing rods being extended upward and downward behind stops. The weight of the door or the door leaves in the case of the currently known low-voltage switchgear cabinets is taken essentially by the hinged suspension of the door or the door leaves on the profiled bar or bars.

SUMMARY

The object of the invention is to provide a device of the type stated at the beginning with which the loading of the door hinges is reduced.

According to the disclosure, at least one guiding element is provided, with at least one run-up sloping surface or run-up slope, which in the case of a one-leaf door is arranged in the region on the free side edge and interacts with a run-up edge on the profiled bar against which the door strikes in such a way that, during closing, the guiding element slides with its run-up slope onto the run-up edge and thereby takes part of the weight of the door.

In the case of a two-leaf door, the at least one guiding element is located in the region of the upper side edge of each door leaf and in the vicinity of the vertical free side edges and, during closing, slides with its run-up slope onto a respective run-up edge at least on the upper horizontal profiled bar, so that the guiding element takes the weight of the door leaves. In an expedient way, a guiding element is respectively provided on the two door leaves in the region of the free side edges.

With the use of the guiding element or the guiding elements, the door hinges are no longer subjected to the load of the entire weight of the door or the door leaves; part of the weight is then also taken by the guiding elements.

According to a further refinement of the invention, if the closing rods are formed from flat material, the guiding element may be formed with a lug, which lug engages over an edge of the closing rod to guide the latter.

In an expedient way, the closing rod is arranged such that it is aligned with its rod side surfaces perpendicular to the fastening plane for the guiding element; the sliding surface consequently runs in an expedient way perpendicular to the fastening plane; the lug is formed in an L-shaped manner, the free leg of the L shape running parallel to the sliding surface toward the fastening plane, so that, when the closing rod is installed with its wide side surfaces perpendicular to the surface of the door, the lug engages over the free longitudinal edge and the closing rod slides along with its wide side on the sliding surface.

According to a particularly advantageous refinement of the invention, the guiding element is formed in a trapezoidal manner, all the delimiting surfaces other than the fastening surface and the sliding surface, which run perpendicular to each other, narrowing toward the free end—as seen from the fastening surface.

Further advantageous refinements and improvements of the invention can be taken from the further subclaims.

BRIEF DESCRIPTION OF THE DRAWINGS

The invention and further advantageous refinements and improvements and further advantages are to be explained and described in more detail on the basis of the drawing, in which two exemplary embodiments are represented and in which.

DETAILED DESCRIPTION

Figure 4:
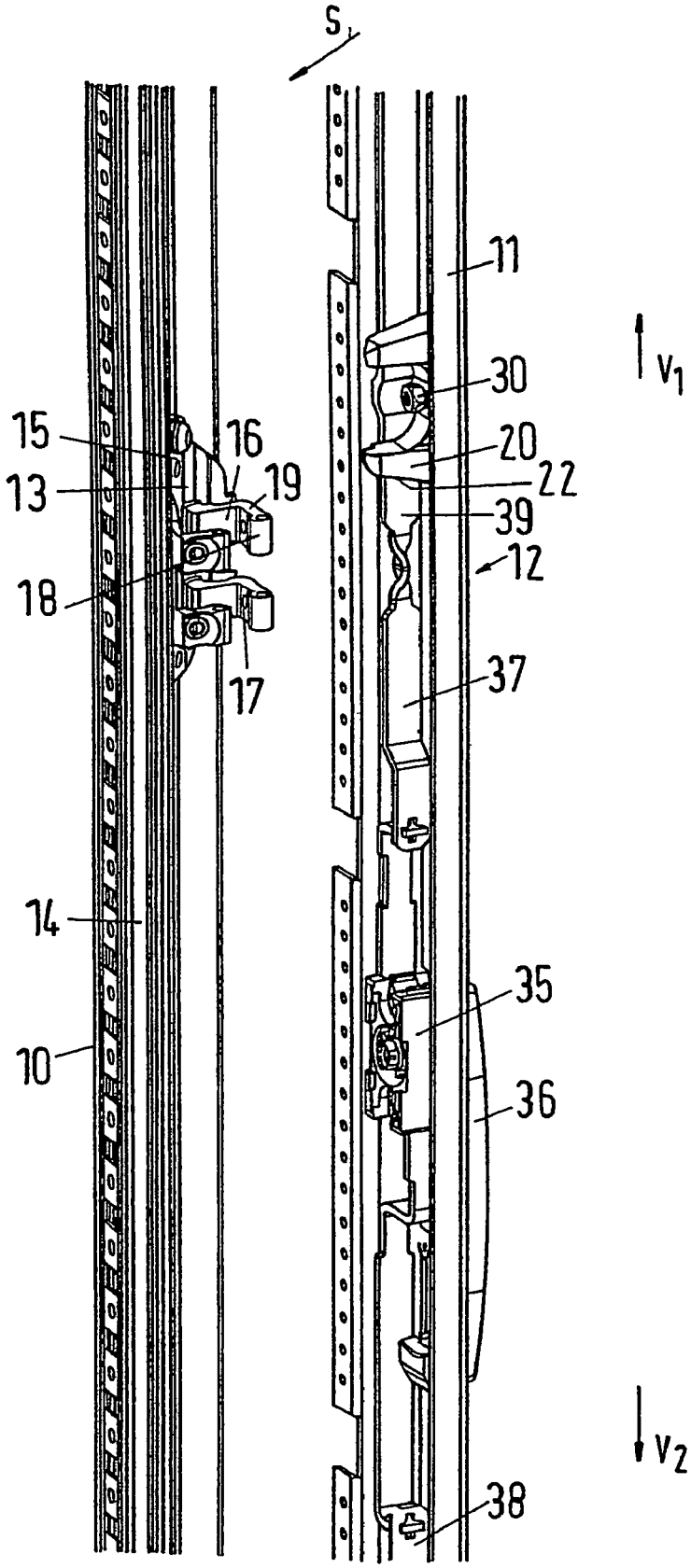
FIG. 4 shows a door leaf with a guiding element according to the invention as shown in FIGS. 1 to 3 and a run-up edge and FIG. 5 shows a perspective view of the upper part-region of a two-leaf door.

Reference is firstly to be made to FIG. 4.

A switchgear cabinet for a low-voltage switchgear assembly comprises as a base structure a frame which is made up of a number of profiled bars, which are arranged perpendicularly on one another and are connected to one another by means of corner connectors.

FIG. 4 then shows the vertically running profiled bar 10 of the frame (not represented any further), against which the side edge 11 of a one-leaf door 12 comes to lie.

Fastened on the outer surface of the profiled bar 10, which has a triangular cross-sectional shape with a hypotenuse 14, which is directed outwards as seen from the interior of the switchgear cabinet, is a holding block 13, which has for instance an elongated rectangular base plate 15, formed on which are arms 16 and 17, of which the upper arm 16 has, in the same way as the lower arm 17, a leg 18 running parallel to the front wall or the surface of the door, the upper end edge 19 of which leg, as seen in the drawing of FIG. 4, forms a run-up edge for a guiding element 20 fastened in the interior of the door 12.

Figure 1:
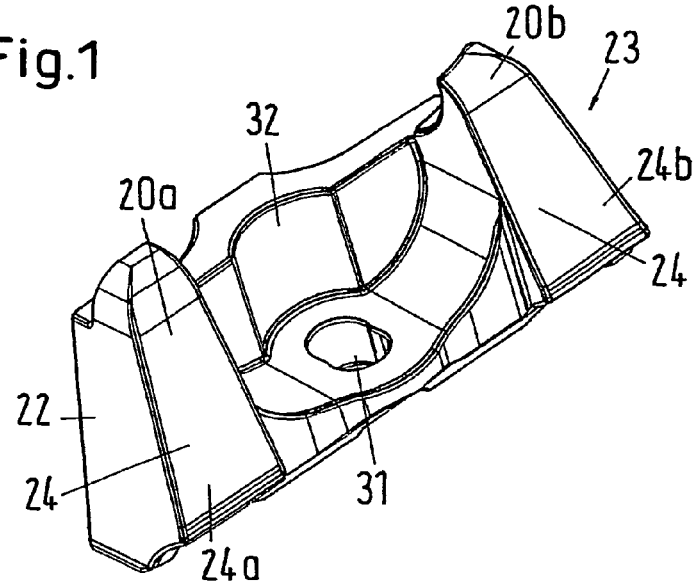
FIGS. 1 to 3 show three different perspective views of a guiding element
Figure 2:
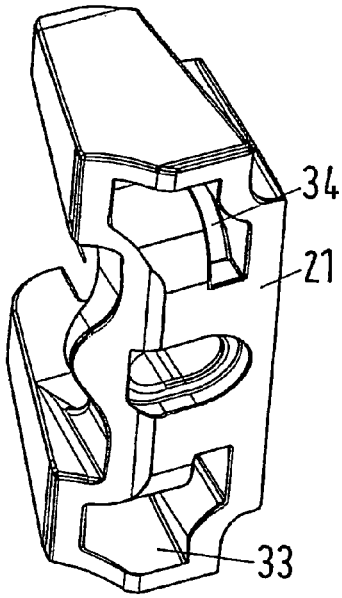
Figure 3:
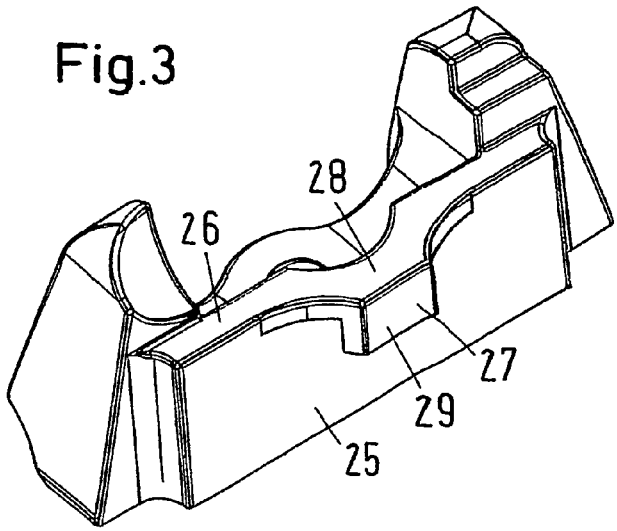

The guiding element 20 is described in more detail in FIGS. 1 to 3. It has a fastening side 21, which is also referred to as the fastening surface and with which the fastening element 20 is placed onto the inner surface of the door 12 and fastened to it. Extending from this fastening surface 21 are run-up surfaces 22, 23 and 24, the two run-up surfaces 22 and 23 approaching each other toward the free end—as seen from the fastening surface 21—so that the two together form a V shape which is open toward the fastening surface 21. The run-up surfaces 24 run at an angle of <90° to the fastening surface, so that these surfaces 24 are also run-up surfaces. FIG. 1 shows two run-up surfaces 24, which have the reference numerals 24*a* and 24*b*; both run-up surfaces 24*a* and 24*b* lie in one plane and the intermediate space between the guiding element portions 20*a* and 20*b* merely has the task of reducing the weight of the guiding element 20.

Formed perpendicular to the fastening surface 21 is a sliding surface 25, on the edge 26 of which, lying opposite from the fastening surface 21, there is formed a hook-shaped or L-shaped lug 27, which has a first leg 28, running perpendicular to the sliding surface 25 or parallel to the fastening surface 21, and a second leg 29, projecting parallel to the sliding surface 25 toward the fastening surface 21.

Reference is now to be made to FIG. 4. Fastened to the inner side of the door leaf 11, by means of a screw connection 30, is the guiding element 20 represented in FIGS. 1 to 3, the fastening surface 21 coming to lie on the inner surface of the door leaf. For insertion through the screw connection 30, a through-hole 31 is provided in the guiding element 20. The fact that recesses 32 and the like can also be provided at the same time is of no significance for the invention. Recesses 33 and 34 that extend from the fastening surface 21 and continue into the free ends of the parts 20*a*, 20*b* serve merely for saving weight.

Arranged on the inner side of the door is a fastening lock 35, which is not represented any more specifically and can be operated by means of a handle 36 arranged on the outer side of the door leaf. This lock 35 serves the purpose of displacing closing rods 37 and 38, the closing rod 37 being moved upward in the direction of the arrow $V_1$ and the closing rod 38 being moved downward in the direction of the arrow $V_2$ for closing and in the opposite directions for unlocking the closure. The closing rods 37 have an elongated rectangular cross section, the wide side surfaces 39 of the closing rods 37, 38 running perpendicular to the door leaf. One of the side surfaces 39 slides on the sliding surface 25 of the guiding element and the closing rods are guided by the guiding element, since their narrow longitudinal edge, lying opposite from the door leaf, is enclosed by the leg 29.

If the door is now to be closed, the vertical free side edge of the door 11 moves in the direction of the arrow S against the profiled bar 10, the run-up surface or side surface 22 sliding against the run-up edge 19 on the leg 18; as a result, the door is raised and part of the weight is carried by the run-up edge 19 and the run-up surface 22 on the guiding part 20.

Figure 5:
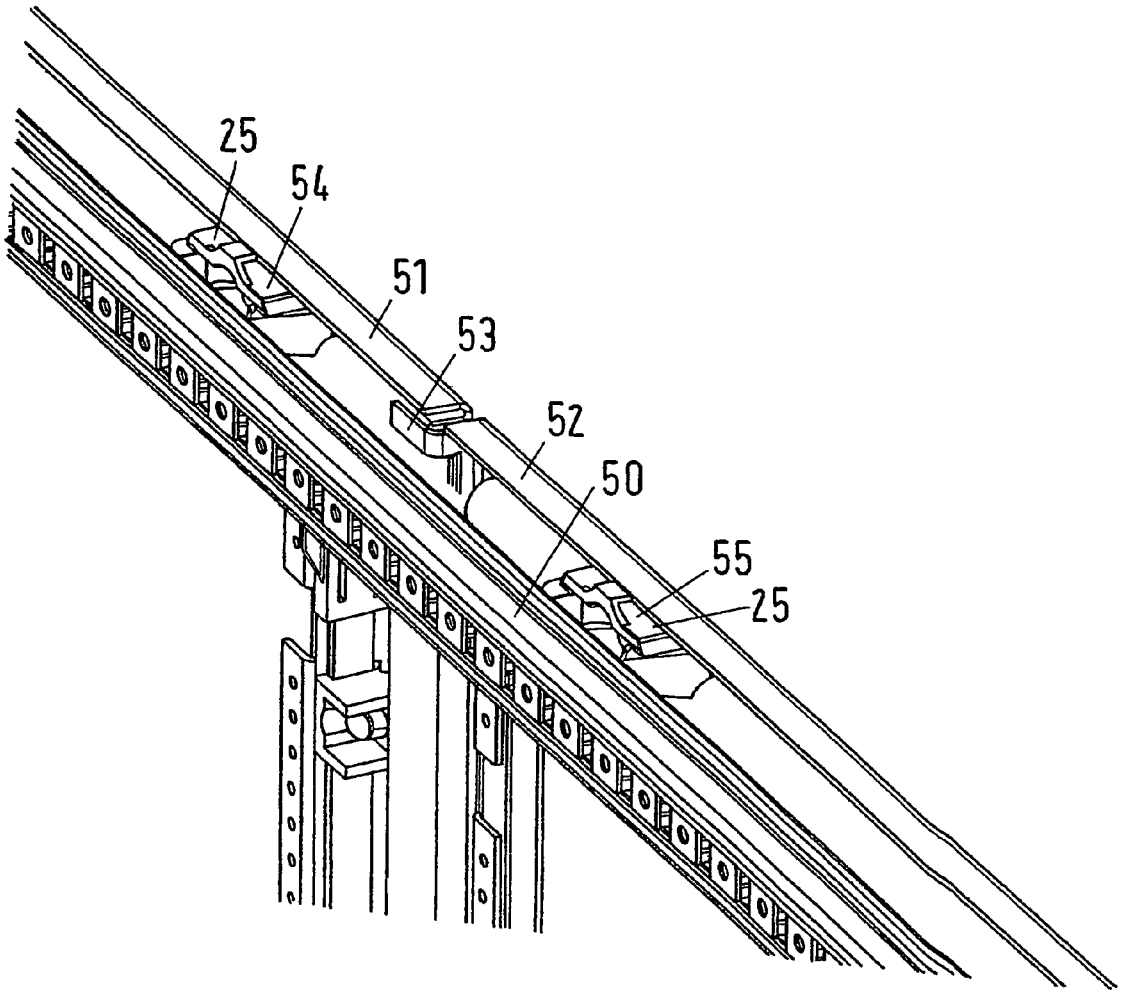

Reference is now to be made to FIG. 5. A part-region of a switchgear cabinet frame is represented, seen from above, toward the inner surface of the door in the interior of the switchgear cabinet. The switchgear cabinet frame has a horizontally running profiled bar 50, which corresponds to the profiled bar 10. The switchgear cabinet has a so-called two-leaf door with a first door leaf 51 and a second door leaf 52, which in the closed state lie with their free side edges next to one another. Formed on the door leaf 52 is a tab 53, which lies behind the door leaf 51, so that the door leaf 52 is kept closed by means of the door leaf 51 via the tab 53. Fastened to the inner surface both of the door leaf 51 and of the door leaf 52 is a respective guiding element 54 and 55, which corresponds identically to the guiding element as shown in FIGS. 1 to 3. The sliding surface 25 runs perpendicular to the respective inner surfaces of the door leaves 51 and 52 and is respectively located on the side directed toward the upper end of the door leaves. As a result, the run-up surfaces 24, 24*a*, 24*b*, not visible here, lie underneath and can run onto a run-up edge or onto two run-up edges provided on the upper horizontally running profiled bar; in this case there is the possibility that the run-up edge is formed by the profiled bar 50 itself or by a run-up leg fastened to the profiled bar 50.

The invention claimed is:

1. A device for taking weight of a one-leaf or two-leaf door for a cabinet, comprising:

at least one guiding element, each guiding element having a first and second run-up slope, which for a one-leaf door are arranged in a region on a free side edge of the one-leaf door and interact with a run-up edge on a profiled bar against which the door strikes in such a way that, during closing, the first run-up slope slides onto the run-up edge and thereby takes part of a weight of the door, and which in the case of a two-leaf door is arranged in a region of an upper side edge and in a vicinity of free side edges of each door leaf of the two-leaf door and, during closing, the second run-up slope slides onto a respective run-up edge at least on an upper horizontally running profiled bar, and takes part of a weight of the door leaves;

a fastening surface defining a fastening plane at which the device is fastened onto the cabinet; and a sliding surface perpendicular to the fastening surface for guiding a closing rod of the one-leaf door.

2. The device as claimed in claim 1, wherein a lug is formed on the sliding surface.

3. The device as claimed in claim 2, wherein the lug is formed in an L-shaped manner, a free leg of the L shape running parallel to the sliding surface toward the fastening plane.

4. The device as claimed in claim 1, wherein the at least two run-up surfaces being arranged substantially perpendicular to each other and tapered in a direction away from the fastening surface.

5. A device for taking weight of a one-leaf or two-leaf door for a cabinet, comprising:

a first guiding element having first and second run-up slopes;

a second guide element having third and fourth run-up slopes wherein the guiding elements for a one-leaf door are arranged in a region on a free side edge of the one-leaf door and interact with a run-up edge on a profile bar against which the door strikes in such a way that during closing, the first run-up slope slides onto the run-up edge and thereby takes part of a weight of the door, and which in the case of a two-leaf door is arranged in a region of an upper side edge and in a vicinity of free side edges of each door leaf of the two-leaf door and, during closing, the second and fourth run-up slopes slide onto a respective run-up edge at least on an upper horizontally running profile bar, and consequently takes part of a weight of the door leaves, wherein the second and fourth run-up slopes are co-planar.

6. A switchgear cabinet, comprising the device according to claim 1.

* * * * *